US011168561B2

(12) United States Patent
Fang et al.

(10) Patent No.: US 11,168,561 B2
(45) Date of Patent: Nov. 9, 2021

(54) DOWNHOLE POSITION MEASUREMENT USING WIRELESS TRANSMITTERS AND RECEIVERS

(71) Applicants: Lei Fang, Houston, TX (US); Michael Johnson, Katy, TX (US); Herb Dhuet, Richmond, TX (US); Roger Steinsiek, Houston, TX (US)

(72) Inventors: Lei Fang, Houston, TX (US); Michael Johnson, Katy, TX (US); Herb Dhuet, Richmond, TX (US); Roger Steinsiek, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 200 days.

(21) Appl. No.: 16/216,408

(22) Filed: Dec. 11, 2018

(65) Prior Publication Data

US 2019/0211667 A1 Jul. 11, 2019

Related U.S. Application Data

(60) Provisional application No. 62/620,866, filed on Jan. 23, 2018, provisional application No. 62/616,267, filed on Jan. 11, 2018.

(51) Int. Cl.

| | |
|---|---|
| ***E21B 47/09*** | (2012.01) |
| ***E21B 47/16*** | (2006.01) |
| ***E21B 47/095*** | (2012.01) |

(52) U.S. Cl.

CPC ..... *E21B 47/09* (2013.01); *E21B 47/095* (2020.05); *E21B 47/16* (2013.01)

(58) Field of Classification Search

CPC ..... E21B 47/09; E21B 47/095; E21B 47/16
See application file for complete search history.

(56) References Cited

U.S. PATENT DOCUMENTS 2,999,557 A * 9/1961 Smith ..... E21B 47/04 367/181
6,333,699 B1 * 12/2001 Zierolf ..... G06Q 20/367 340/854.8

(Continued)

FOREIGN PATENT DOCUMENTS

WO 2017196357 A1 11/2017

OTHER PUBLICATIONS

PCT International Search Report and Written Opinion for International application No. PCT/US2018/064910; International filing date: Dec. 11, 2018; dated Mar. 25, 2019; 12 pgs.

*Primary Examiner* — Blake E Michener
(74) *Attorney, Agent, or Firm* — Cantor Colburn LLP

(57) ABSTRACT

An apparatus for determining a location of a downhole component includes at least one transmitter device and a receiver device. One of the at least one transmitter device and the receiver device is disposed at a first component of a borehole string configured to be deployed in a borehole and retained at a stationary position, and another of the at least one transmitter device and the receiver device is disposed at a moveable component configured to be moved while the first component is at the stationary position, the at least one transmitter device configured to emit a wireless signal and the receiver device configured to detect the wireless signal when the first component is at the stationary position. The apparatus also includes a processing device configured to receive signal data and estimate a location of the moveable component relative to the first component based on the signal data.

18 Claims, 5 Drawing Sheets

(56) References Cited

U.S. PATENT DOCUMENTS 6,333,700 B1 * 12/2001 Thomeer ..... E21B 47/26 340/854.8
7,874,362 B2 * 1/2011 Coates ..... E21B 47/04 166/299
8,646,520 B2 * 2/2014 Chen ..... E21B 47/11 166/66.5
9,732,606 B2 8/2017 Frosell et al.
2002/0084071 A1 * 7/2002 McCoy ..... E21B 47/008 166/255.1
2002/0093431 A1 7/2002 Zierolf
2003/0062155 A1 * 4/2003 Summers ..... E21B 47/095 166/66
2008/0008043 A1 * 1/2008 Jong ..... E21B 47/095 367/127
2008/0030365 A1 2/2008 Fripp et al.
2008/0089175 A1 * 4/2008 Miszewski ..... E21B 47/14 367/35
2008/0239872 A1 * 10/2008 Miller ..... G01V 1/52 367/83
2009/0120637 A1 * 5/2009 Kirkwood ..... E21B 47/13 166/254.2
2011/0132607 A1 6/2011 Lahitette et al.
2012/0014211 A1 * 1/2012 Maida, Jr. ..... E21B 47/09 367/13
2016/0003033 A1 * 1/2016 Coles ..... E21B 19/00 73/152.58
2016/0076363 A1 * 3/2016 Morrow ..... E21B 43/11 166/255.1
2016/0273348 A1 9/2016 Echols, III et al.
2016/0312603 A1 * 10/2016 Gottlieb ..... E21B 47/095
2016/0319657 A1 * 11/2016 Szpunar ..... E21B 47/095
2018/0010442 A1 * 1/2018 Coss ..... E21B 34/14
2018/0045037 A1 * 2/2018 Echols, III ..... E21B 47/18
2018/0066511 A1 * 3/2018 Ostermann ..... G01V 3/18

* cited by examiner

DOWNHOLE POSITION MEASUREMENT USING WIRELESS TRANSMITTERS AND RECEIVERS

BACKGROUND

In resource recovery industries (e.g., completions), relative positions of tools or components intended to be left in a borehole, and the associated running or service tools intended to be removed or repositioned in the borehole, can be important to achieve proper completion or other energy industry operations. Traditionally, information related to the relative positions of such tools is gleaned from the surface by various measuring techniques related to how far into the borehole the tools have been run.

SUMMARY

An embodiment of an apparatus for determining a location of a downhole component includes at least one transmitter device configured to emit a wireless signal and a receiver device configured to detect the wireless signal. One of the at least one transmitter device and the receiver device is disposed at a first component of a borehole string configured to be deployed in a borehole and retained at a stationary position, and another of the at least one transmitter device and the receiver device is disposed at a moveable component configured to be moved along the borehole while the first component is at the stationary position, the at least one transmitter device configured to emit the wireless signal and the receiver device configured to detect the wireless signal when the first component is at the stationary position. The apparatus also includes a processing device configured to receive signal data corresponding to the detected wireless signal, and estimate a location of the moveable component relative to the first component based on the signal data.

An embodiment of a method of determining a location of a downhole component includes deploying a borehole string including a first component in a borehole and retaining the borehole string and the first component at a stationary position, the borehole string including one of at least one transmitter device and a receiver device disposed at the first component, the at least one transmitter device configured to emit a wireless signal, and the receiver device configured to detect the wireless signal. The method also includes disposing a moveable component in the borehole, the moveable component configured to be moved while the first component is at the stationary position, where another of the at least one transmitter device and the receiver device is disposed at the moveable component and is configured to move with the moveable component. The method further includes emitting the wireless signal from the at least one transmitter device and detecting the wireless signal when the first component is at the stationary position, and receiving signal data corresponding to the detected wireless signal, and estimating a location of the moveable component relative to the first component based on the signal data.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method is presented herein by way of exemplification and not limitation with reference to the figures.

Disclosed are apparatuses, systems and methods for locating downhole components. An embodiment of a downhole position measurement system includes a transmitter and receiver assembly including a wireless signal transmitter and a receiver configured to detect wireless signals emitted by the transmitter. One of the transmitter and the receiver is disposed at a moveable downhole component and moves with the moveable component, and another of the transmitter and the receiver is disposed at a component that is configured to be fixedly located in the borehole. A processing device analyzes wireless signals detected by the receiver to estimate a location of the moveable component. For example, the system can be utilized to measure changing distances between a service or running tool and a set completion component after releasing the completion component.

For example, a transmitter is disposed at a service tool that is run inside a borehole or borehole string (e.g., drill pipe or casing) and used to activate a packer or other component. A receiver is disposed at a fixed or stationary location in the borehole (e.g., attached to drill pipe or casing) and receives wireless signals. Examples of wireless signals include seismic, acoustic, ultrasonic and/or electromagnetic signals. A processing device analyzes the signals and estimates a distance between the stationary location and the moveable component (e.g., by travel time or magnetic field strength). In one embodiment, the position measurement system is configured to provide accurate real-time measurement of the position of one or more downhole components during an energy industry operation.

Embodiments described herein provide an effective way of utilizing wireless signal generation and detection devices, which have traditionally been used in formation evaluation or for other measurements, to estimate positions of downhole components. Thus, the system can be incorporated into existing energy industry systems without excessive cost or complexity and may utilize existing components.

Figure 1:
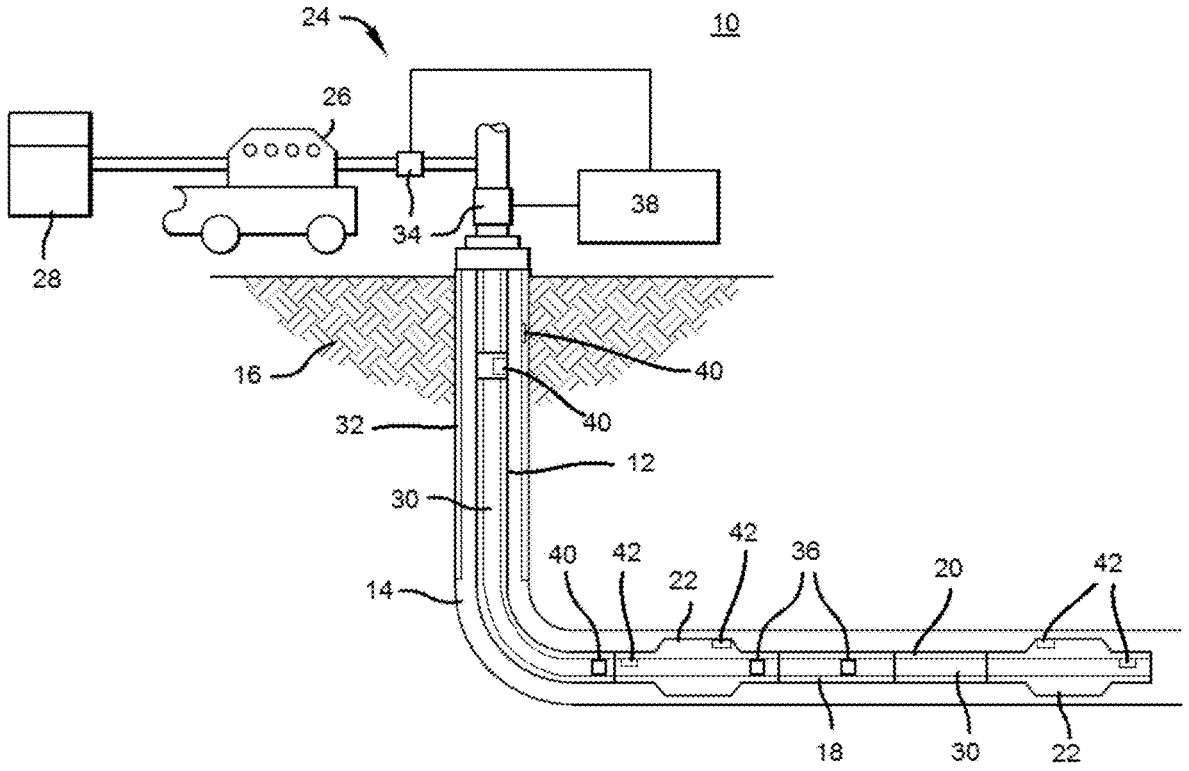
FIG. 1 depicts an embodiment of a system for performing an energy industry operation, which includes a position measurement system.

Referring to FIG. 1, an exemplary embodiment of a system 10 for performing energy industry operations is shown. The system 10, in the embodiment of FIG. 1, is a completion and hydrocarbon production system 10. The system 10 is not so limited, and may be configured to perform any energy industry operation, such as a drilling, stimulation, measurement and/or production operation.

A borehole string 12 including, e.g., a completion string, is configured to be disposed in a borehole 14 that penetrates a resource bearing formation 16 or formation region. The borehole 14 may be an open hole, a cased hole or a partially cased hole. The borehole string 12 may be configured for various uses, such as drilling, completion, stimulation and others, and includes a tubular, such as a coiled tubing, pipe (e.g., multiple pipe segments) or wired pipe, that extends from a wellhead at a surface location (e.g., at a drill site or offshore stimulation vessel). As described herein, a "string" refers to any structure or carrier suitable for lowering a tool or other component through a borehole or connecting a drill bit to the surface, and is not limited to the structure and configuration described herein.

In one embodiment, the borehole string 12 includes a completion and production string configured to be deployed in the borehole 14 to install various components at selected locations to facilitate completion of the borehole 14 or sections thereof. For example, the borehole string 12 includes a completion string having a production assembly 18 including a fracture or "frac" sleeve device, and/or a screen assembly 20. The borehole string 12 may also include additional components, such as one or more isolation or packer assemblies 22.

The system 10 includes surface equipment 24 for performing various energy industry operations. For example, the surface equipment 24 is configured for injection of fluids into the borehole 14 in order to, e.g., complete the borehole 14, actuate devices and/or facilitate production. In one embodiment, the surface equipment 24 includes an injection device such as a high pressure pump 26 in fluid communication with a fluid tank 28, mixing unit or other fluid source or combination of fluid sources. The pump 26 facilitates injection of fluids, such as a sand or gravel slurry and/or a stimulation fluid (e.g., a hydraulic fracturing fluid).

To facilitate deploying and setting downhole components such as packers, sleeves and other fluid control devices, a service string 30 (also referred to as a work string or running string) is deployed into the borehole 14 through an interior bore of the borehole string 12. The service string 30 may be deployed to set various components and be subsequently tripped out of the borehole 14 or otherwise moved along a length of the borehole 14. For example, the service string 30 is deployed into the borehole 14 to set the packer assemblies 22 and/or the production assembly 18.

It is noted that the work string 30 is not limited to being deployed through the borehole string 12. For example, the work string 30 may be deployed through other borehole components such as a casing 32.

Various sensors and/or measurement tools may be included in the system 10 at surface and/or downhole locations. For example, one or more flow rate and/or pressure sensors 34 may be disposed in fluid communication with the pump 26 and the borehole string 12 for measurement of fluid characteristics. The sensors 34 may be positioned at any suitable location, such as proximate to or within the pump 26, at or near the wellhead, or at any other location along the borehole string 12 or the borehole 14. Other sensors include, for example, pressure and/or temperature sensors 36.

The system 10 also includes a position measurement system that includes one or more receivers 40 and one or more transmitters 42. The one or more receivers 40 and the one or more transmitters 42 are configured to detect and emit wireless signals, respectively, and may be referred to as wireless receivers and wireless transmitters. The one or more receivers 40, in one embodiment, are positioned at a fixed or known location or locations relative to the borehole string 12 and/or the casing 32. For example, the one or more receivers 40 are attached to or connected to the borehole string 12 and/or the casing 32 such that the one or more receivers 40 are stationary when the one or more transmitters 42 emit wireless signals according to embodiments described herein.

Each receiver 40 includes a sensor or transducer configured to detect wireless signals generated by the one or more transmitters 42. For example, each receiver 40 is configured to detect magnetic fields, acoustic signals, ultrasonic signals, electromagnetic signals, gamma rays and/or others.

In one embodiment, the one or more transmitters 42 are disposed with one or more moveable downhole components, such as the service string 30 or components thereof. For example, the service string 30 includes one or more service tools, such as packer setting tools, valve or sleeve actuators and/or cross-over tools.

The one or more transmitters 42 are employed to transmit wireless signals that are detected by the one or more receivers 40 and analyzed to estimate a distance between the one or more receivers 40 and the one or more transmitters 42. As the one or more receivers 40 are located at a known position or known positions, the position measurement system provides distance information that can be used to estimate or infer the location along the borehole 14 of moveable components such as the work string 30 and/or service tools.

The distance information allows, for example, for the detection and quantification of the location of moveable components relative to the known position(s), which allows for an accurate determination of the location of such components. In addition, the distance information may be used to estimate changes in the distance between components of the work string 30 (due, e.g., to changing pressure, temperature and/or other conditions). Such information is useful to monitor deployment of the service string 30 to ensure that the service string 30 is in a proper position. Such information is also useful with respect to guiding the service string 30 to another location in the borehole 14 based upon the position of the service string 30 (and/or a service tool or other component on the work string 30) relative to components of the borehole string 12 (e.g. the packer assemblies 22). It is noted that embodiments described herein are not limited to the system 10, as the embodiments may be used for any component of a borehole.

It is noted that, although the one or more receivers 40 are discussed as being at fixed or stationary locations and the one or more transmitters 42 are discussed as being at one or more moveable components, the position measurement system is not so limited. For example, the one or more receivers 40 can be disposed at one or more moveable components and the one or more transmitters 42 can be disposed at fixed or stationary location. In addition, the one or more receivers 40 and the one or more transmitters 42 can be transducers capable of both emitting and receiving wireless signals.

A processing device, in one embodiment, is operably connected to the one or more receivers 40 and the one or more transmitters 42 to perform functions including receiving signal data from the one or more receivers 40, analyzing or processing the signal data to generate distance information, and/or controlling aspects of the position measurement system. For example, a processing unit 38 may be disposed in operable communication with surface and/or downhole components such as the sensors 34, the sensors 36 and/or the position measurement system. The processing unit 38 is configured to receive, store and/or transmit data generated from the downhole components, and includes processing components configured to analyze data and/or control operational parameters. The processing unit 38 includes any number of suitable components, such as processors, memory, communication devices and power sources.

In one embodiment, the processing unit 38 or other suitable downhole or surface processing device receives signal data from the one or more receivers 40 and analyzes the signal data to measure or estimate a distance between the one or more receivers 40 and the one or more transmitters 42. The processing device may be a surface or downhole processing device. For example, the processing device can be an on-board processor incorporated into or located with the one or more receivers 40.

Signal data may be communicated to a remote location such as a surface location via any suitable communication technique or system. For example, the one or more receivers 40 communicate with the processing unit 38 via wired pipe telemetry, acoustic wireless telemetry, mud pulse telemetry, and/or electromagnetic based telemetry, and/or signal data may be saved in an on board memory chip that can be processed post job.

Figure 2A:
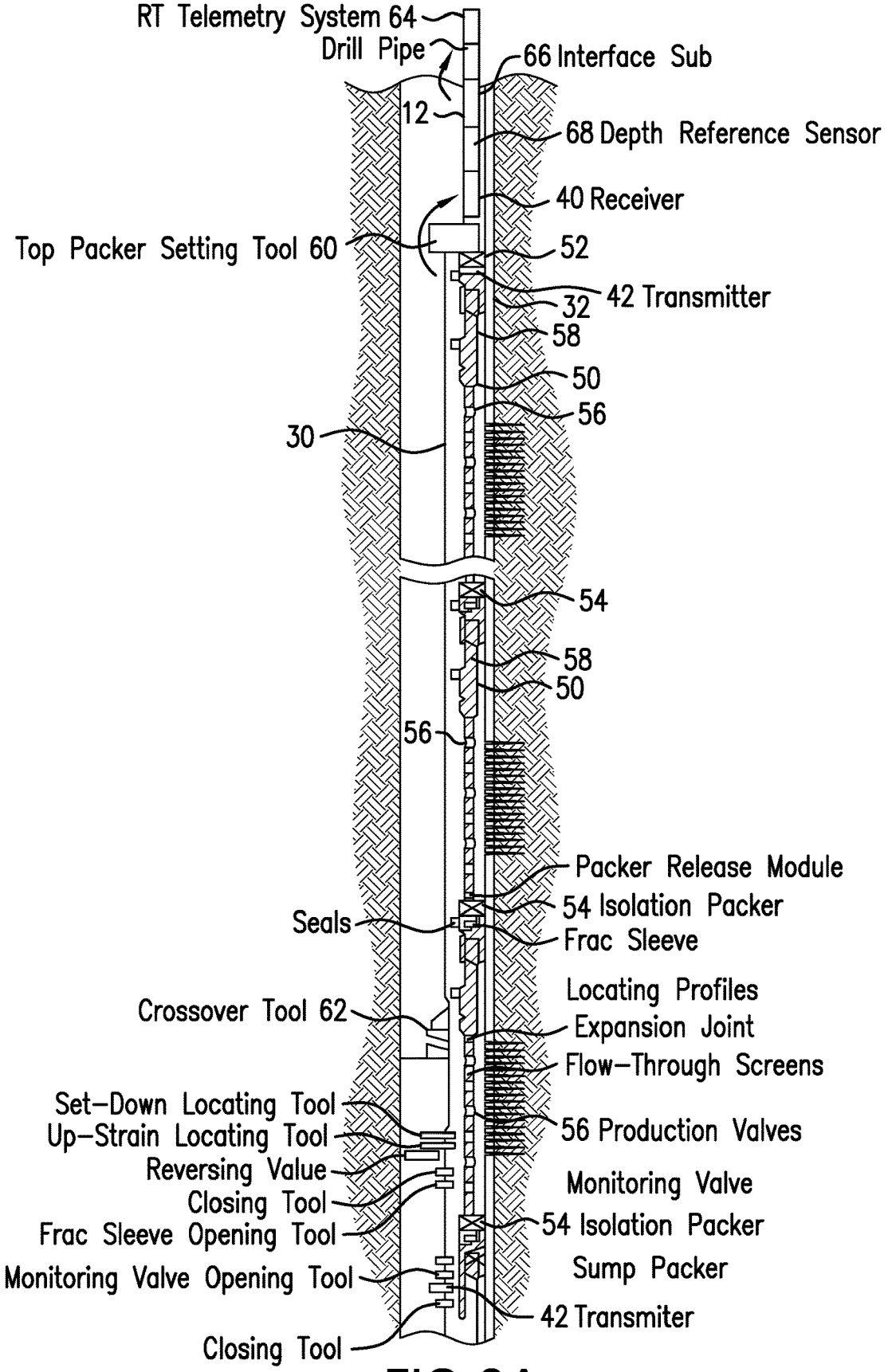
FIG. 2A depicts an embodiment of a position measurement system incorporated in a completion system that includes a completion string and a service tool, where the service tool is at a first position.
Figure 2B:
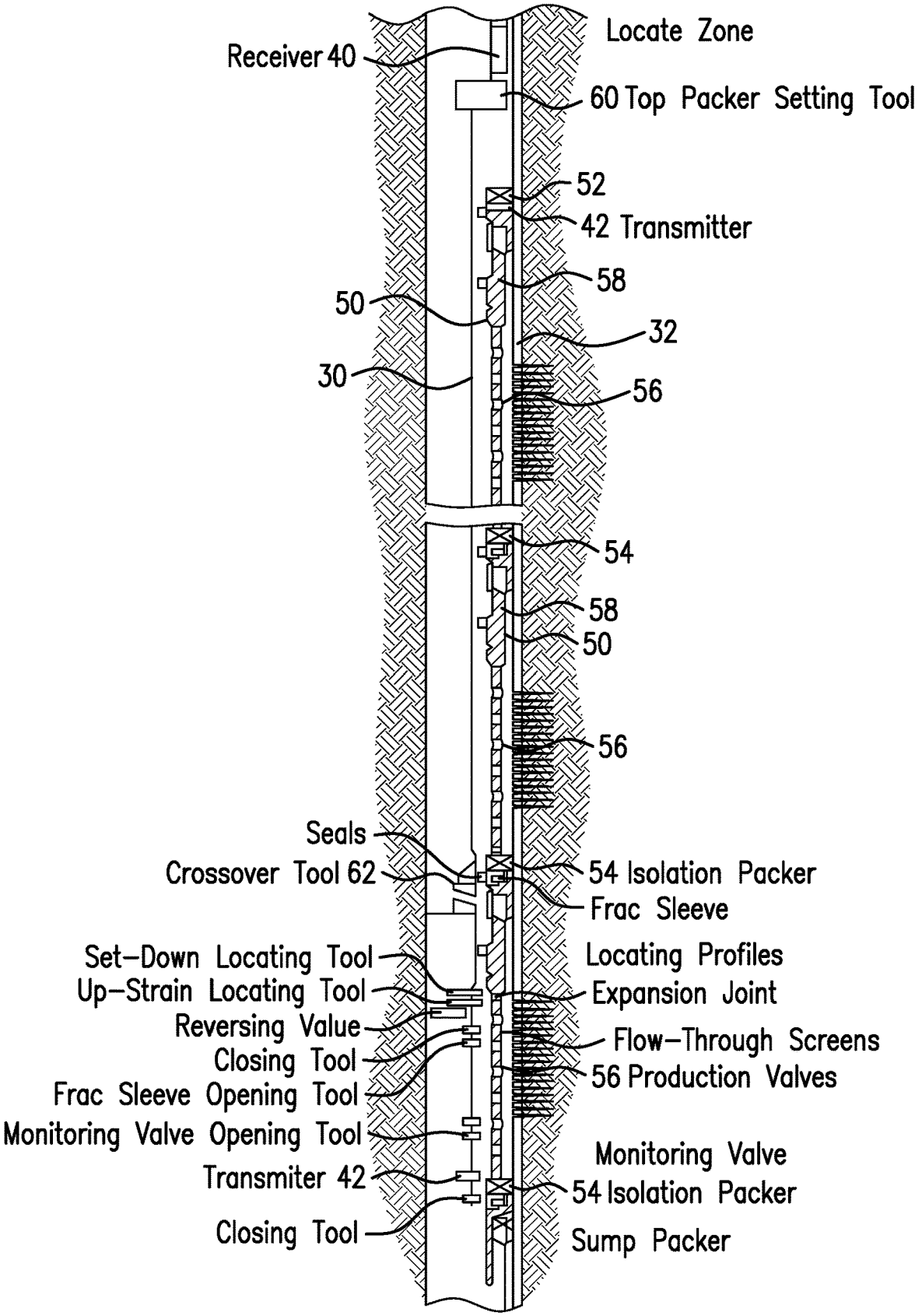
FIG. 2B depicts the position measurement system and the completion system of FIG. 1, where the service tool is at a retracted position.

One embodiment of the position measurement system is shown in FIGS. 2A and 2B. In this embodiment, the borehole string 12 includes drill pipe or another tubular on which a receiver 40 is disposed. The receiver 40 is disposed at a known location on the borehole string 12, such that the receiver 40 is located at a fixed known position when the borehole string 12 has been deployed to a selected depth or location. One or more transmitters 42 are attached to the service string 30 such that each transmitter 42 moves with the service string 30 or at least the portion of the service string (e.g., the service tool) at which the transmitter 42 is attached. It is noted that there may be multiple (e.g., two) transmitters 42 that are part of the service string 30. As noted above, embodiments may include one or more transmitters 42 disposed at a fixed and/or known location, and one or more receivers 40 disposed at one or more moveable components. For example, one or more transmitters 42 can be disposed at a known location on or in the borehole string 12, and/or at known locations on or in a casing.

The borehole string 12 in this embodiment includes a completion string 50 having a top packer 52 and isolation packers 54 for establishing production zones. For each production zone, the completion string 50 includes a sand screen 56, a frac sleeve 58 and other components such as flow control devices and sensors.

The service string 30 includes various service components or tools. For example, the service string includes a top packer setting tool 60 and a cross-over tool 62. As shown in FIG. 2A, the service string 30 is deployed to a first location and activates or sets components such as the packers 52 and 54. Other components, such as the cross-over tool 62, may be included to facilitate injection of fluid into the production zones, e.g., a gravel slurry during a gravel packing operation. The service string 30 can then be released and can be moved to another location and/or tripped out to the surface. For example, as shown in FIG. 2B, the service string 30 is released after the top packer 52 and/or the packers 54 are set, and then pulled uphole a selected distance (e.g., a few feet) to set other components.

Each transmitter 42 emits wireless signals, such as acoustic signals, when the service string 30 is at various locations (and/or when the service string 30 is moving) to provide information about the location of one or more service tools or other moveable downhole components. Furthermore, the wireless signals can be used to determine the relative position of a service tool relative to the receiver 40 to determine whether the service string 30 has deformed (e.g., lengthened or contracted). For example, the position of service tools relative to the top packer 52 can change due to, e.g., temperature, pressure or fluid density changes. This change can result in an inaccurate estimation of service tool location when measured using conventional surface-based position measurements. The position measurement system thus can provide more accurate location information.

The wireless signals may be any suitable signals that can be detected for the purpose of identifying a location of a moveable component such as the work string 30 or component on the work string. For example, the transmitters 42 are acoustic transducers such as Tonpilz transducers (sometimes referred to as "singing mushrooms") or other acoustic frequency generators.

In one embodiment, the one or more receivers 40 and the one or more transmitters 42 may be incorporated with existing measurement systems. For example, acoustic logging tools can be equipped with transmitters 42 and/or receivers 40, or configured to emit acoustic signals having tones or other characteristics that are different than acoustic signals used for logging (e.g., formation evaluation). Combining the acoustic logging tool sensors with tone generators in this way can provide a means of accurate service tool location relative to completion hardware.

The system 10, in one embodiment, includes a telemetry system 64 that allows signal data to be transmitted to a processing device such as the processing unit 38. The telemetry system 64 may be a real-time telemetry system. In one embodiment, the borehole string 12 includes an interface module or interface sub 66 that enables transmission of signal data and/or position information from the downhole positioning measurement system to the telemetry system 64. Some embodiments also include software that processes downhole measurement data and visualizes positioning of downhole tools.

The telemetry system 64 may utilize any suitable type of telemetry, such as wired pipe telemetry, acoustic wireless telemetry, mud pulse telemetry or electromagnetic based telemetry. For example, the interface sub 66 is an acoustic short hop sub, one end of which is connected to the position measurement system and the other end of which transmits data to the telemetry system 64.

In one embodiment, the system 10 includes one or more reference location devices. For example, a reference sensor 68 is disposed at the borehole string 12 and provides a reference location by which the location of the receiver 40 can be confirmed or corrected. The reference sensor 68 may be configured to detect features of the borehole 12 and/or downhole components that are at known depths or locations along the borehole 12. For example, the reference sensor 68 is an electromagnetic sensor (e.g., similar to a casing collar locator), a gamma ray measurement device or other suitable sensor for detecting features such as casing collars, liner tops, cement tops, casing joints or profiles, known irregularities in a cement bond log, and others.

Additionally, the reference sensor 68 may be employed advantageously to determine the location of a service tool while it is tripping, since the reference sensor 68 may be configured (such as through travel time) to recognize features known to be in the borehole (e.g., packers, casing collars, etc.), measure casing thickness, measure impedance, or otherwise recognize borehole wall features or casing features. Such features may be used to determine position within the borehole 14.

In one embodiment, multiple transmitters 42 are located at different positions and/or with different moveable components. For example, the system 10 includes a first transmitter 42 at or near the top packer 52 and a second transmitter 42 at or near the bottom of the service string 30. Other transmitters 42 may be included, such as at each isolation packer 54.

In one embodiment, if multiple transmitters 42 are utilized, each transmitter 42 may be configured to emit wireless signals with different characteristics. For example, each transmitter 42 can emit acoustic signals, each with different characteristics such as frequency, pulse length, duty cycle, amplitude, acoustic signature, and/or others.

It is noted that terms used herein, such as top, bottom, uphole and downhole, can denote relative depths, positions and directions along a borehole. As some borehole or borehole sections are not vertical (e.g., are deviated or horizontal), such terms may not correspond to vertical positions and directions.

Figure 3:
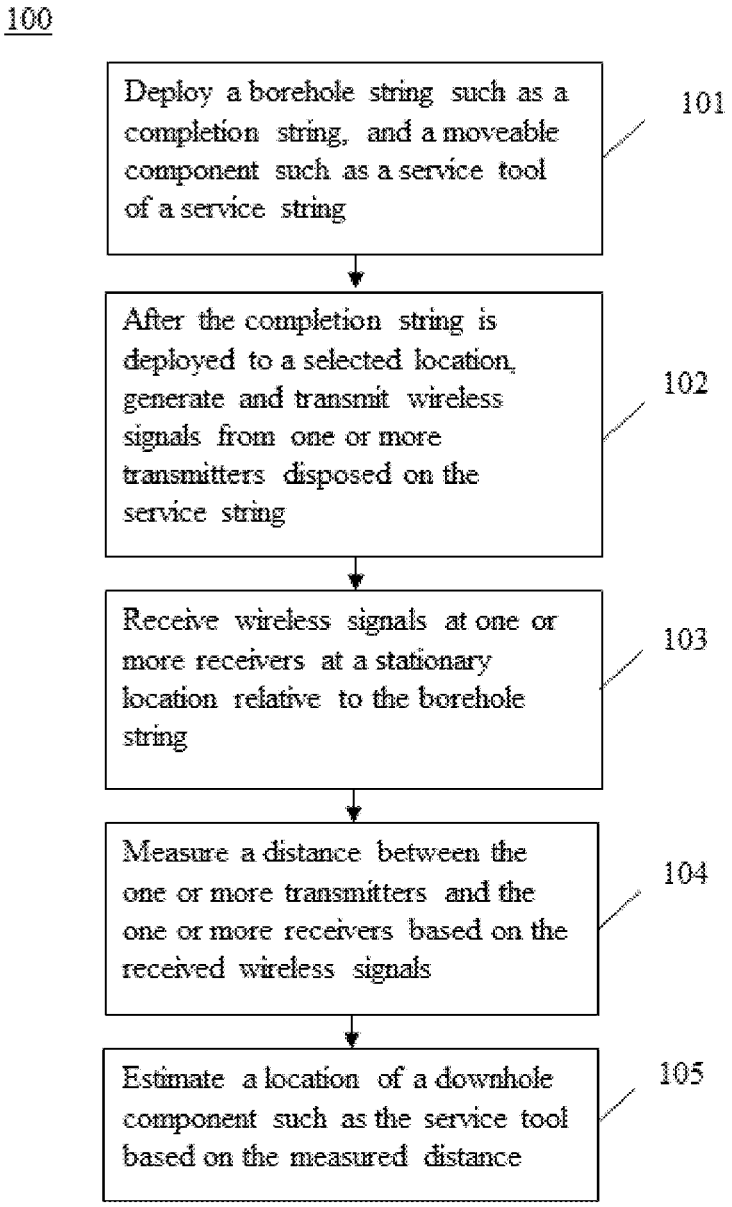
FIG. 3 is a flow chart for a method of estimating a position of a moveable downhole component such as a service tool.

FIG. 3 illustrates a method 100 for estimating locations of downhole components and/or performing aspects of an energy industry operation. The method 100 includes one or more of stages 100-105 described herein, at least portions of which may be performed by a processor (e.g., the processing unit 38 or a downhole processor). In one embodiment, the method 100 includes the execution of all of stages 101-105 in the order described. However, certain stages 101-105 may be omitted, stages may be added, or the order of the stages changed.

The method 100 is discussed in conjunction with the system 10, but is not so limited and can be performed with any suitable system or method for which location information of a downhole component is desired. In addition, the method 100 is discussed for illustrative purpose in conjunction with a gravel packing operation but is not so limited and can be performed in conjunction with a variety of energy industry operations. Examples of such operations include whipstock operations, reentry operations, side tracking operations, borehole isolation operations, abandonment operations, deployment of liner hangers, operations that include spacing out sealing assemblies, and others.

In the first stage 101, the borehole string 12 is deployed in the borehole 14 and advanced to a selected location. The borehole string 12 includes aspects of the position measurement system, including at least one acoustic receiver 40. The borehole string 12 includes at least one receiver that is fixedly disposed relative to the borehole string or fixedly disposed at the casing, such that the position of the receiver 40 is known.

A mobile or moveable component such as the work string 30 is deployed through the borehole string 12 and includes one or more service tools, such as the top packer setting tool 60 and the cross-over tool 62. The service tools are used to activate or set components such as the packers 52 and 54 to isolate production zones. Once the packers 52 and 54 are set, a gravel slurry may be injected to form a gravel pack around the borehole string at selected production zones, e.g., around each sand screen 56. Once the gravel packing is completed, a variety of other completion functions are performed, such as installing production strings. To perform subsequent operations, the service string 30 may be pulled out of the borehole string 12.

The position measurement system in this embodiment includes at least one transmitter 42 configured to emit wireless signals, and at least one receiver 40. The at least one receiver 40 is disposed at a known position, and a transmitter 42 is attached to the service string 30 at or near the top packer 52, either with the top packer 52 or in a separate module. For example, the transmitter 42 is disposed in a transmitter module that is powered from the surface or by a downhole power supply such as a battery.

In the second stage 102, once the borehole string 12 is disposed at a selected location along the borehole 14 and the service string 30 is deployed downhole, wireless signals are generated by one or more transmitters 42 disposed on the service string 30.

For example, the service string 30 includes a first transmitter 42 at or near the top packer 52, and a second transmitter 42 at or near the bottom of the service string 30. Other transmitters 42 may be included, e.g., at or near the cross-over tool 62. Each transmitter 42 may be configured to emit wireless signals with different characteristics, so that the receiver 40 can receive signals that can be differentiated to identify respective service tools or locations on the work string 30.

The transmitters 42 may be configured to transmit signals continuously, near-continuously or at selected times. For example, the transmitters 42 continuously or periodically each emit an acoustic signal with distinctively different designed characteristics (e.g., in frequency and/or amplitude). Such signals can be transmitted in real-time during an operation.

In the third stage 103, the wireless signals travel through the fluid column and are received by one or more receivers 40, such as the receiver 40 disposed on the borehole string 12 uphole from the completion string 50. The wireless signals may include identification of each transmitter 42 and/or the time of each transmission.

In the fourth stage 104, the distance between the receiver 40 and each transmitter 42 is estimated. For example, the receiver 40 (or other processing device such as the processing unit 38) measures the travel time of each acoustic signal from emission to reception, and processes the signals to determine the distance between the transmitters 42 and the receiver 40. The processing may be carried out downhole in a processor or at a remote location such as the surface.

In the fifth stage 105, based on the determined distance between the transmitters 42 and the receiver 40, the positions of downhole tools of interest can be inferred or otherwise estimated. For example, the distance between the transmitter 42 at or near the top packer 52 and the receiver 40 provides the position of the transmitter 42, given the known position of the receiver 40, and thereby provides the position of the top packer 52. Likewise, the distance between the transmitter 42 at or near the bottom of the service string 30 and the receiver 40 can provide the location of the bottom of the work string 30, and can also provide insights on potential stretch or buckling of the service string 30 below the receiver 40. From these two measured distances, the position of any point of interest in the service string 30 can be inferred.

In one embodiment, these measurements are transmitted to the processor in real time or near real time. The measurements may be taken at least substantially continuously or periodically, and then transmitted (e.g., in real time) to a processing device. Other measurements such as formation evaluation measurements may also be taken. In one embodiment, various sensor devices are incorporated into an integrated downhole tool or other component that measures various directional and evaluation parameters in real time as part of a measurement while drilling (MWD) or logging while drilling (LWD) method.

An example of a calculation that may be performed to determine the location of a downhole component is discussed as follows. This calculation or other calculations using the estimated locations of transmitters can be used to infer the position of any part of the service string 30 (e.g., the cross-over tool 62).

In this example, a moveable downhole component such as the cross-over tool 62 is disposed at a first position along the service string 30. The first position is located at a distance dx from a known position of a wireless receiver R. The actual distance dx may not be known, as surface measurements of the first position may be inaccurate due to downhole conditions (e.g., temperature and pressure) that can affect the length of the service string 30.

A first transmitter T1 is disposed at a second location (e.g., at or near the top of the service string 30), and a second transmitter T2 is disposed at a third location (e.g., at or near the bottom of the service string 30).

A surface measurement of the distance between the receiver R and the downhole component is shown as dx_surface, and a surface measurement of the location of the second transmitter T2 is shown as d2_surface.

Figure 4:
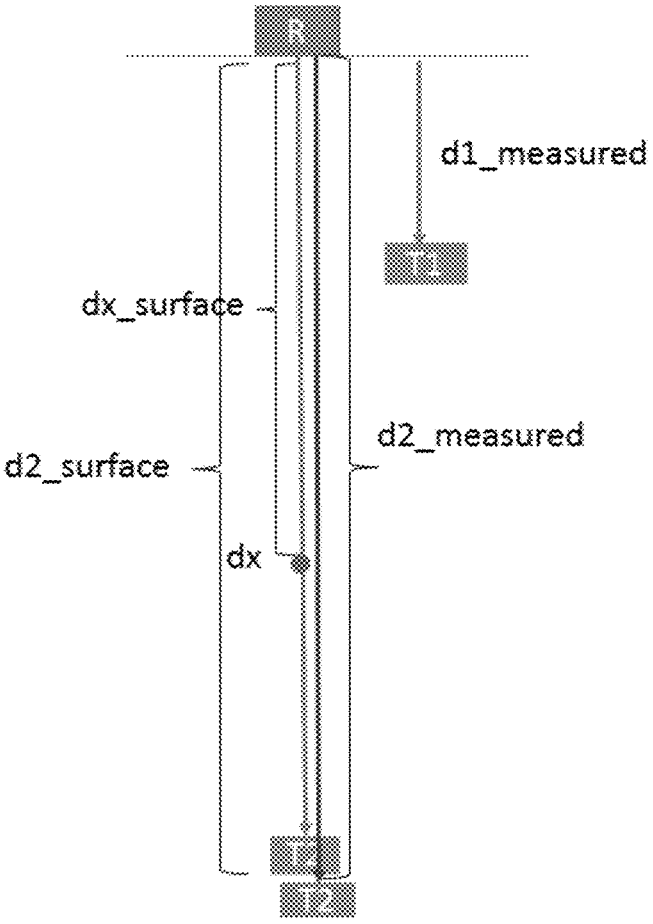
FIG. 4 illustrates aspects of an example of a calculation of a position of a downhole component.

As shown in FIG. 4, changes in length of the work string 30 can cause the position of the transmitter T2 to change, thus the surface measurements dx_surface and d2_surface may not be accurate. The position measurement system can be used to correct such surface measurements.

The location of the transmitter T1 is determined by calculating a distance d1_measured based on a calculation of the travel time of wireless signals between the transmitter T1 and the receiver R. In addition, the location of the transmitter T2 is determined by calculating a distance d2_measured based on a calculation of the travel time between the transmitter T2 and the receiver R.

Knowing the surface distance measurements and the measurements from the position measuring system allows for accurate estimation of the location of the downhole component, even if the service string length has changed.

The actual distance dx can then be calculated based on surface measurements and wireless signals is as follows:

$$d_x = d_{1_measured} - d_{x_surface} - \frac{d_{x_surface}}{d_{2_surface}} x(d_{2_measured} - d_{2_surface}).$$

Set forth below are some embodiments of the foregoing disclosure.

Embodiment 1

An apparatus for determining a location of a downhole component, including at least one transmitter device configured to emit a wireless signal; a receiver device configured to detect the wireless signal, wherein one of the at least one transmitter device and the receiver device is disposed at a first component of a borehole string configured to be deployed in a borehole and retained at a stationary position, and another of the at least one transmitter device and the receiver device is disposed at a moveable component configured to be moved along the borehole while the first component is at the stationary position, the at least one transmitter device configured to emit the wireless signal and the receiver device configured to detect the wireless signal when the first component is at the stationary position; and a processing device configured to receive signal data corresponding to the detected wireless signal, and estimate a location of the moveable component relative to the first component based on the signal data.

Embodiment 2

The apparatus as in any prior embodiment, wherein the wireless signal is an acoustic signal.

Embodiment 3

The apparatus as in any prior embodiment, wherein the processing device is configured to calculate a travel time of the detected wireless signal from the at least one transmitter device to the receiver device, and estimate the location based on the travel time.

Embodiment 4

The apparatus as in any prior embodiment, wherein the first component is part of a completion string, and the moveable component is a service tool disposed at a service string configured to be moved along the borehole relative to the completion string.

Embodiment 5

The apparatus as in any prior embodiment, wherein the at least one transmitter device includes a first wireless transmitter at an end of the service string, and a second wireless transmitter at another location of the service string, the receiver device includes a wireless receiver disposed at a fixed location on the completion string and configured to detect wireless signals from the first wireless transmitter and the second wireless transmitter, and the processing device is configured to estimate a location of the second transmitter relative to the first transmitter.

Embodiment 6

The apparatus as in any prior embodiment, wherein the first component is part of a borehole casing.

Embodiment 7

The apparatus as in any prior embodiment, wherein the at least one transmitter device is disposed at the moveable component and the receiver device is fixedly disposed relative to the stationary location.

Embodiment 8

The apparatus as in any prior embodiment, wherein the at least one transmitter device includes a signal transmitter and a signal receiver, the signal receiver is configured to detect signals from the signal transmitter that are indicative of a feature of the borehole proximate to the signal transmitter and the signal receiver, and the processing device is configured to estimate a reference position of the moveable component relative to the feature.

Embodiment 9

The apparatus as in any prior embodiment, wherein the feature includes at least one of a feature of a borehole wall, a characteristic of a downhole component and a characteristic of a borehole casing.

Embodiment 10

The apparatus of claim 1, further comprising a position sensor disposed at the borehole string, the position sensor configured to generate reference position data corresponding to a reference position on the borehole string.

Embodiment 11

A method of determining a location of a downhole component, including: deploying a borehole string including a first component in a borehole and retaining the borehole string and the first component at a stationary position, the borehole string including one of at least one transmitter device and a receiver device disposed at the first component, the at least one transmitter device configured to emit a wireless signal, and the receiver device configured to detect the wireless signal; disposing a moveable component in the borehole, the moveable component configured to be moved while the first component is at the stationary position, wherein another of the at least one transmitter device and the receiver device is disposed at the moveable component and is configured to move with the moveable component; emitting the wireless signal from the at least one transmitter device and detecting the wireless signal when the first component is at the stationary position; and receiving signal data corresponding to the detected wireless signal, and estimating a location of the moveable component relative to the first component based on the signal data.

Embodiment 12

The method as in any prior embodiment, wherein the wireless signal is an acoustic signal.

Embodiment 13

The method as in any prior embodiment, wherein estimating the location includes calculating a travel time of the detected wireless signal from the at least one transmitter device to the receiver device.

Embodiment 14

The method as in any prior embodiment, wherein the first component is part of a completion string, and the moveable component is a service tool disposed at a service string configured to be moved along the borehole relative to the completion string.

Embodiment 15

The method as in any prior embodiment, wherein the at least one transmitter device includes a first wireless transmitter at an end of the service string, and a second wireless transmitter at another location of the service string, the receiver device includes a wireless receiver disposed at a fixed location in the completion string and configured to detect wireless signals from the first wireless transmitter and the second wireless transmitter, and the method includes estimating a location of the second transmitter relative to the first transmitter.

Embodiment 16

The method as in any prior embodiment, wherein the first component is part of a borehole casing.

Embodiment 17

The method as in any prior embodiment, wherein the at least one transmitter device is disposed at the moveable component and the receiver device is fixedly disposed relative to the stationary location.

Embodiment 18

The method as in any prior embodiment, wherein the transmitter device includes a signal transmitter and a signal receiver, the signal receiver is configured to detect signals from the transmitter that are indicative of a feature of the borehole proximate to the signal transmitter and the signal receiver, and the processing device is configured to estimate a reference position of the moveable component relative to the feature.

Embodiment 19

The method as in any prior embodiment, wherein the feature includes at least one of a feature of a borehole wall, a characteristic of a downhole component and a characteristic of a borehole casing.

Embodiment 20

The method as in any prior embodiment, further comprising generating reference position data corresponding to a reference position on the borehole string by a reference position sensor.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An apparatus for determining a location of a downhole component, comprising:

at least one transmitter device configured to generate and emit a wireless signal, the at least one transmitter device including a first wireless transmitter and a second wireless transmitter, the first wireless transmitter disposed at a first borehole string or a second borehole string, and the second wireless transmitter disposed at the second borehole string, the second borehole string including a moveable component configured to be moved along a borehole relative to the first borehole string when the first borehole string is at a stationary position in the borehole;

a receiver device configured to detect the wireless signals from the first wireless transmitter and the second wireless transmitter;

a reference sensor disposed at a fixed location relative to the first borehole string, the reference sensor configured to detect a feature proximate to the reference sensor, the feature located at a known position in the borehole; and a processing device configured to receive signal data corresponding to the detected wireless signals and receive position data from the reference sensor estimate a location of the moveable component relative to the first borehole string based on the signal data and the position data, and estimate a location of the second transmitter relative to the first transmitter.

2. The apparatus of claim 1, wherein the wireless signals include acoustic signals.

3. The apparatus of claim 2, wherein the processing device is configured to calculate a travel time of a detected wireless signal from the first transmitter to the receiver device, and estimate the location based on the travel time.

4. The apparatus of claim 1, wherein the first borehole string is a completion string, and the moveable component is a service tool disposed at a service string configured to be moved along the borehole relative to the completion string.

5. The apparatus of claim 4, wherein the first wireless transmitter is disposed at an end of the service string, and the second wireless transmitter is disposed proximate to a component of the completion string, and the receiver device includes a wireless receiver disposed at a fixed location on the completion string.

6. The apparatus of claim 1, wherein the first borehole string is a borehole casing.

7. The apparatus of claim 1, wherein the at least one transmitter device is disposed at the moveable component and the receiver device is fixedly disposed relative to the stationary position.

8. The apparatus of claim 7, wherein the processing device is configured to estimate a reference position of the moveable component relative to the feature based on the known location of the feature.

9. The apparatus of claim 1, wherein the feature includes at least one of a feature of a borehole wall, a characteristic of a downhole component and a characteristic of a borehole casing.

10. A method of determining a location of a downhole component, comprising:

deploying a first borehole string in a borehole and retaining the first borehole string at a stationary position, the first borehole string including a reference sensor disposed at a fixed location relative to the first borehole string;

deploying a second borehole string including a moveable component in the borehole, the moveable component configured to be moved while the first borehole string is at the stationary position, wherein a first wireless transmitter and a wireless receiver are disposed at the first borehole string or the second borehole string, and a second wireless transmitter is disposed at the second borehole string;

detecting, by the reference sensor, a feature of at least one of the first borehole string and the borehole proximate to the reference sensor, the feature located at a known position in the borehole;

emitting wireless signals from the first wireless transmitter and the second wireless transmitter, and detecting the wireless signals by the wireless receiver when the first borehole string is at the stationary position; and receiving signal data corresponding to the detected wireless signals, receiving position data from the reference sensor, estimating a location of the moveable component relative to the first borehole string based on the signal data and the position data, and estimating a location of the second transmitter relative to the first transmitter.

11. The method of claim 10, wherein the wireless signals include acoustic signals.

12. The method of claim 11, wherein estimating the location includes calculating a travel time of a detected wireless signal from the first wireless transmitter to the wireless receiver.

13. The method of claim 10, wherein the first borehole string is a completion string, and the moveable component is a service tool disposed at a service string configured to be moved along the borehole relative to the completion string.

14. The method of claim 13, wherein the first wireless transmitter is disposed at an end of the service string, the second wireless transmitter is disposed proximate to a component of the completion string, the wireless receiver disposed at a fixed location in the completion string.

15. The method of claim 10, wherein the first component borehole string is a borehole casing.

16. The method of claim 10, wherein the at least one first wireless transmitter is disposed at the moveable component and the wireless receiver is fixedly disposed relative to the stationary position.

17. The method of claim 16, wherein the processing device is configured to estimate a reference position of the moveable component relative to the feature based on the known location of the feature.

18. The method of claim 10, wherein the feature includes at least one of a feature of a borehole wall, a characteristic of a downhole component and a characteristic of a borehole casing.

* * * * *